United States Patent [19]

Liu et al.

[11] Patent Number: 4,673,304

[45] Date of Patent: Jun. 16, 1987

[54] THERMAL PRINTER RIBBON CARTRIDGE FOR WIDE RIBBONS

[75] Inventors: Dean-Yuan Liu, Canoga Park; Albert A. Sholtis, Long Beach, both of Calif.

[73] Assignee: Sanders Associates, Inc., Nashua, N.H.

[21] Appl. No.: 765,077

[22] Filed: Aug. 13, 1985

[51] Int. Cl.[4] ..... B41J 32/00

[52] U.S. Cl. ..... 400/208; 400/120; 400/224.2; 400/225; 400/240.3; 400/240.4; 400/242; 101/336

[58] Field of Search ..... 400/120, 207, 208, 208.1, 400/224, 240.3, 225, 240.4, 242; 101/93.04, 93.05, 336; 346/76 R, 76 L, 76 PH, 138

[56] References Cited

U.S. PATENT DOCUMENTS

| | | | |
|---|---|---|---|
| 797,888 | 8/1905 | Follett | 400/208 |
| 3,026,987 | 3/1962 | Gather | 400/225 X |
| 3,393,790 | 7/1968 | Dixon | 400/242 |
| 3,400,800 | 9/1968 | McMillan et al. | 101/336 X |
| 3,774,538 | 11/1973 | Bullock | 400/208 X |
| 3,807,543 | 4/1974 | Robinson et al. | 400/242 |
| 3,855,926 | 12/1974 | Dikoff | 400/208 X |
| 3,923,267 | 12/1975 | Eckerd et al. | 400/225 X |
| 3,952,649 | 4/1976 | Dikoff | 101/336 X |
| 3,954,167 | 5/1976 | Kranz et al. | 400/225 X |
| 3,991,676 | 11/1976 | Sasaki | 101/336 X |
| 4,160,605 | 7/1979 | Neubaum | 400/208 |
| 4,289,069 | 9/1981 | Melissa et al. | 400/240.3 X |
| 4,388,628 | 6/1983 | Moriguchi et al. | 400/240.3 X |
| 4,401,390 | 8/1983 | Melissa et al. | 400/240.3 |
| 4,496,955 | 1/1985 | Maeyama et al. | 346/138 X |
| 4,502,057 | 2/1985 | Kawano et al. | 400/240.3 X |
| 4,505,603 | 3/1985 | Yana | 400/240.3 X |
| 4,534,666 | 8/1985 | Watanabe | 400/207 |
| 4,551,729 | 11/1985 | Kubo et al. | 400/240.3 X |
| 4,552,470 | 11/1985 | Yana et al. | 400/240.3 X |
| 4,558,329 | 12/1985 | Honda | 400/240.3 X |
| 4,594,597 | 6/1986 | Liu et al. | 346/76 PH |

FOREIGN PATENT DOCUMENTS

| | | | |
|---|---|---|---|
| 386405 | 12/1923 | Fed. Rep. of Germany | 400/242 |
| 3425953 | 1/1985 | Fed. Rep. of Germany | 400/120 |
| 0067278 | 6/1981 | Japan | 400/208 |
| 0024478 | 2/1983 | Japan | 400/208 |
| 0173687 | 10/1983 | Japan | 400/120 |
| 0193184 | 11/1983 | Japan | 400/120 |

*Primary Examiner*—Ernest T. Wright, Jr.

*Attorney, Agent, or Firm*—Richard I. Seligman; William F. Porter, Jr.

[57] ABSTRACT

A user-friendly ribbon cartridge to house and to facilitate handling a wide thermal transfer ribbon for a thermal color printer is composed of first and second casing sections which define a slotted let-off tube and a slotted take-up tube and turnbar. A pair of casing end pieces connect the corresponding ends of the casing sections so that they are juxtaposed with their axes parallel to one another so as to define a plane and the turnbar is spaced parallel to that plane so that a stretch of ribbon wound about cores rotatively mounted in the tubes can extend out through the tube slots and over the turnbar creating a large unobstructed planar ribbon area that is accessible from both sides for printing. A handle and latch member integral to one of the end pieces facilitate positioning the cartridge properly in the associated printing apparatus and locking it in place during printing. The cores are removable from the casing tubes by releasable cap assemblies in the end piece at the handle end of the cartridge so that all of the components of the cartridge can be reused if desired. The ribbon is advanced by means of a gear motor coupled to the core in the take-up tube by way of a mechanical slip clutch so that the take-up core can be rotated at different speeds without overloading the motor. There is also provision for monitoring the position of the ribbon in the cartridge.

25 Claims, 4 Drawing Figures

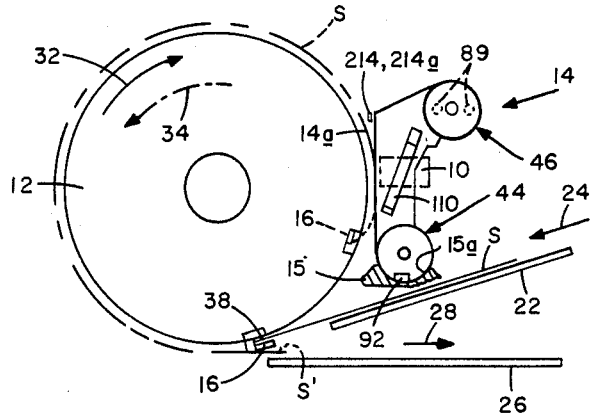
FIG. 1
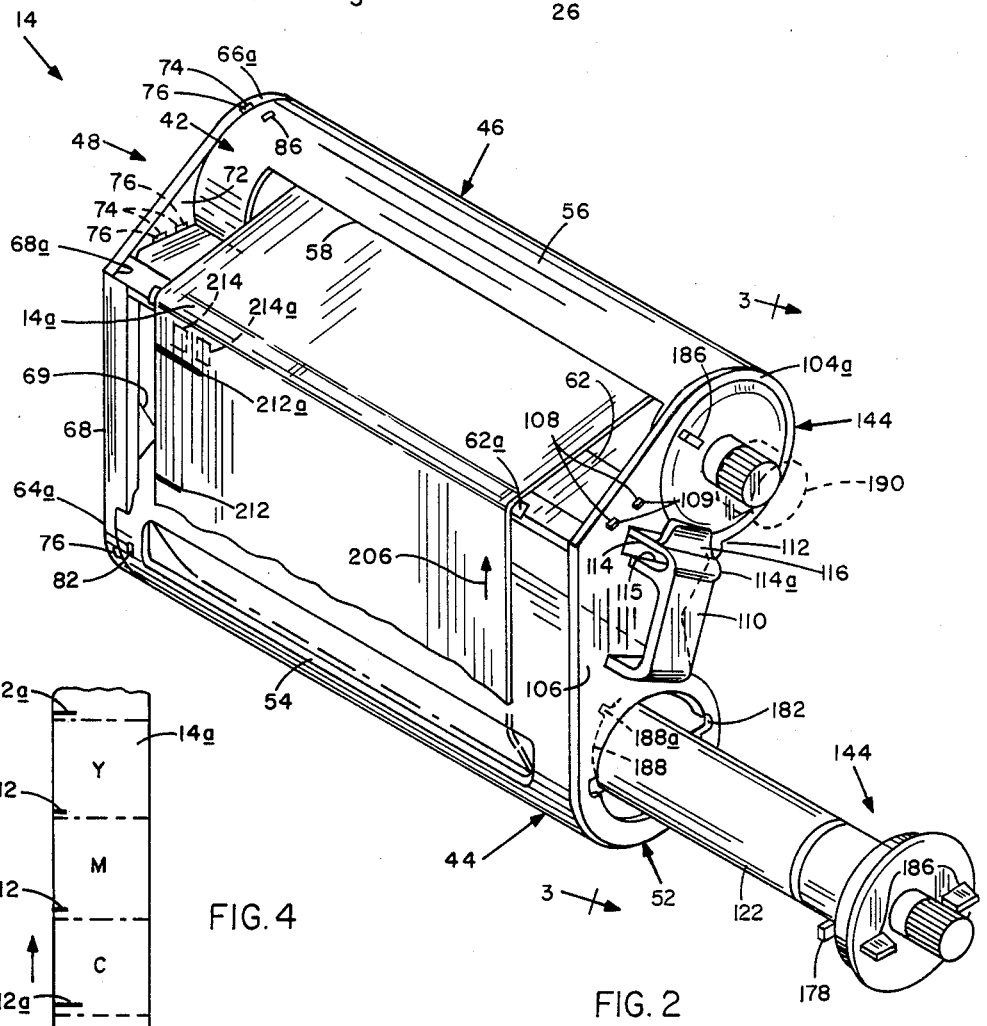
FIG. 4
FIG. 2

THERMAL PRINTER RIBBON CARTRIDGE FOR WIDE RIBBONS

This invention relates generally to a printer for printing in color on individual paper sheets fed by a sheet feeder to a rotatable drum which rotates the sheet past a plural-color printing station a plurality of times following which the sheet is removed from the drum and replaced by the next sheet to be printed on. It relates more particularly to an improved print ribbon cartridge for placement at the printing station to facilitate printing in one or more colors on the successive sheets to be printed on.

BACKGROUND OF THE INVENTION

In a typical plural-color thermal printer, successive sheets of paper are fed from a sheet source to a drum. Each sheet is wrapped around the drum and rotated into position opposite a thermal print head located adjacent to the drum. The print head has a plurality of addressable vertical wires and a single horizontal wire in its surface closest to the drum. By sending current to the horizontal wire and one of the addressable wires, the intersection of the two wires can be heated at a selected point along the length of the drum.

A spooled print ribbon having a plurality of color bands in a repeatable sequence is disposed to pass between the print head and the drum. Usually, the ribbon has repeating sets of color bands corresponding to the primary subtractive colors cyan, magenta and yellow, and sometimes black. The colors are present on the ribbon as a thin heat-transferable wax coating on the side of the ribbon facing the drum.

In a typical thermal printer, after a sheet of paper is wrapped around the drum, the drum is rotated to position the sheet at a reference or "top-of-sheet" position opposite the print head. Also, the print ribbon is positioned so that the top of the first color band on the ribbon is located at the top of the paper sheet. A mechanism then moves the print head so that it presses the ribbon and paper sheet against the drum following which the wires of the print head are addressed sequentially across the head according to control signals from a controller representing a line of print information. The wires of the print head are thus heated at selected pixel locations or points along the drum causing spots or dots of way of the first color on the print ribbon to be melted into the paper sheet along the first line to be printed. Next, the paper sheet and ribbon are advanced one line by rotating the drum and ribbon take-up spool. The wires of the print head are again energized selectively by the controller to print the second line of dots of the first color on the paper sheet. This print-and-feed sequence is repeated until the desired length of the sheet is printed with dot matrix characters and lines of the first color.

Following this, the head is retracted from the ribbon and the drum is rotated to its top-of-sheet position and the print ribbon is advanced to place the top of its second color band in alignment for printing on the first line of the sheet. The head is then repositioned against the ribbon and the above-described print-and-feed sequence is repeated until the paper sheet has been printed with the second color, following which the drum is again returned to the top-of-sheet position to print the third color on the sheet. This process is continued until all of the desired colors have been printed on the sheet. The printed sheet is then removed from the drum to be replaced by the next sheet to be printed on.

As seen from the foregoing, in this type of printer, there is not relative movement of the print head and the drum when printing on a given line of the recording sheet supported on the drum. In other words, a thermal printer, unlike a daisy wheel printer, dot matrix printer, and even the basic typewriter, is a form of line printer which prints on the recording medium line by line. This means that the print ribbon in a thermal printer or recorder must have a width that is commensurate to the width of the paper sheet or other recording medium. In addition, in thermal printing, the ink or thermal transfer medium on the print ribbon is actually melted and transferred from the ribbon to the paper sheet at each point on the ribbon heated by the print head. Therefore, each point on the print ribbon can only be used once. This means that, as a practical matter, it requires a separate print ribbon segment or band to print each color on each successive paper sheet to be printed on by the printer. Thus, for color printing using the three primary colors, up to three ribbon segments or bands may be required to print each sheet. Accordingly, if a printer is to be able to print on a reasonable number of such sheets successively, its print ribbon must be quite large. For example, to print on one hundred $8\frac{1}{2}$ by 11 inch paper sheets, the print ribbon would have to be $8\frac{1}{2}$ inches wide and at least 3300 inches long.

In many prior thermal printers , the print ribbon is fed from a supply or let-off spool to a driven take-up spool. When replacing each ribbon, the now-empty supply spool must be removed and replaced by a new spool containing a fresh ribbon. Also, the now-full take-up spool must be removed and replaced by an empty take-up spool and the leading edge margin of the new ribbon must be threaded along the ribbon path and secured to the new take-up spool. Examples of conventional printers of this type are disclosed in U.S. Pat. Nos. 4,289,069; 4,388,628; 4,401,390 and 4,502,057. As will be appreciated, changing the print ribbon in these machines is a somewhat tedious and time-consuming process. Also, the process creates opportunities for scratching, creasing or otherwise damaging the fresh print ribbon.

It has, of course, been proposed to facilitate ribbon replacement by incorporating the print ribbon into a cartridge or cassette which can be releasably positioned at the proper location in the printer. This has been done quite successfully in the past in the case of photographic film and magnetic tape. However, the practical application of this proposal or concept to a thermal transfer ribbon has proven to be difficult due primarily to the aforementioned size requirements for such a ribbon. In other words, the spooling of film or magnetic tape in a cassette or cartridge can be accomplished relatively easily and inexpensively. Because the film and tape are quite narrow, it is a relatively simple matter to guide each strip properly within the cassette or cartridge. Also, the cartridge or cassette can be quite small. Therefore, that component does not constitute a significant part of the overall cost of the printer or recorder. Moreover, it is easy to locate the small cartridge or cassette properly in the associated apparatus so that its tape or strip can be operated on by the apparatus.

In the case of a thermal transfer ribbon, however, it is difficult to justify doing this because of the high cost of the cassette enclosure itself, although the housing of such a ribbon in a cassete has indeed been proposed (see U.S. Pat. No. 4,496,955). Also, being so large, the prior print ribbon cassettes typified by the one disclosed in the just-mentioned patent are not particularly user friendly. That is, they are not designed with the user in mind to permit quick and easy replacement of the cassettes in the printer. Additionally, they are one-shot or disposable units which are discarded after their ribbons are used up, which is wasteful. Still further, they often require a relatively expensive servo system including a servo motor to advance their ribbons. These last two factors add appreciably to the cost and complexity of the printer as a whole and militate against the wider use and application of such cassette-type thermal printers.

SUMMARY OF THE INVENTION

Accordingly, it is an object of the present invention to provide an improved print ribbon cartridge for a thermal printer.

Another object of the invention is to provide a thermal print ribbon cartridge which can be reused many times to house different print ribbons.

A further object of the invention is to provide a thermal print ribbon cartridge which is relatively easy and inexpensive to make and assemble.

Still another object of the invention is to provide a cartridge of this type which is user friendly in that its design facilitates its use and insertion into and removal from the associated printing or recording apparatus.

Yet another object of the invention is to provide a cartridge of this type which does not require a servo drive to advance and properly position the ribbon in the cartridge.

A further object is to provide such a cartridge which guides the print ribbon properly and reliably past the print head of the associated recorder or printer.

Other objects will, in part, be obvious and will, in part, appear hereinafter.

The invention accordingly comprises the features of construction, combination of elements and arrangement of parts which wll be exemplified in the following detailed description, and the scope of the invention will be indicated in the claims.

The print ribbon cartridge of this invention is made substantially entirely of molded plastic parts which interfit to form a rugged, impact-resistant reusable enclosure for protecting the print ribbon while it is on the shelf and for feeding the ribbon reliably past a print head when positioned properly in the associated printer. The cartridge casing defines a slotted feed tube, a slotted take-up tube and a ribbon turnbar positioned in the ribbon path between the two tubes. A spool or core with the print ribbon wrapped around it is rotatively mounted in the feed tube, with the ribbon passing out through the slot in the feed tube around the turnbar and in through the slot in the take-up tube where it is wrapped around a similar empty ribbon spool or core rotatively mounted in the latter tube. The placements of the tubes and turnbar on the casing are such that there is a relatively large straight planar ribbon run between the slot in the supply tube and the turnbar which can be engaged easily from behind by the long print head of a thermal printer.

The casing take-up and turnbar are formed as a molded unit which is connected to the casing supply tube by opposite end pieces that interfit with the ends of the tubes and turnbar to create a casing which is especially resistant to being strained violently and is rugged enough though the casing is almost a foot long in order to accommodate the abovedescribed wide plural-color print ribbon of the type commonly used in thermal printers.

The ribbon spools which let out and wind up the print ribbon during printing are also molded parts which coact with the casing to provide an especially smooth advancement of the ribbon from the let-off spool around the turnbar to the take-up spool during printing and the necessary drag to prevent overrunning of the ribbon during such advancement. Therefore, the cartridge certainly contributes to high quality printing by the associated printer. Further, as indicated above, the present cartridge is reusable in that removable end covers or caps are provided for the casing tubes at one end of the cartridge. After the used ribbon is wound fully on the take-up spool, the end caps can be removed to withdraw the spools endwise from the cartridge. The used ribbon on the take-up spool can then be discarded and replaced by a fresh spooled ribbon inserted into the supply tube and the empty let-off spool can be used again as a take-up spool for the new ribbon. The cartridge is specially designed so that the user can draw the leading end of the fresh ribbon from the cartridge feed tube, train it around the turnbar and attach it to an empty spool in the take-up tube with minimum effort and inconvenience. The cartridge is also provided with an integral handle and locking clip to facilitate inserting the cartridge into and removing it from the associated printing apparatus and retaining the cartridge in place in the apparatus during printing.

It is a further feature of this invention that the take-up spool in the present cartridge is rotated to advance the film by a simple electric motor operating through a mechanical slip clutch instead of by an expensive servo motor of the type used to drive conventional ribbon cartridges of this general type. Proper and accurate ribbon advancement and positioning are achieved by monitoring the position of the ribbon through the detection of markings or indicia on the ribbon as will be described in detail later.

In summary then, the present cartridge constitutes a user-friendly unit which, at relatively low cost, enables one to handle a large plural-color thermal transfer ribbon of the type used in present-day thermal printers and to move the ribbon reliably and uniformly past a print head when required to do so during printing.

BRIEF DESCRIPTION OF THE DRAWINGS

For a fuller understanding of the nature and objects of the invention, reference should be had to the following detailed description, taken in connection with the accompanying drawings, in which:

FIG. 1 is a schematic diagram in cross section showing printing apparatus incorporating a print ribbon cartridge made in accordance with this invention;

FIG. 2 is a perspective view on a much larger scale with parts broken away showing the ribbon cartridge in greater detail;

FIG. 4 is a scrap view on a small scale of the print ribbon in the FIG. 2 cartridge.

DETAILED DESCRIPTION OF THE PREFERRED EMBODIMENT

Figure 3:
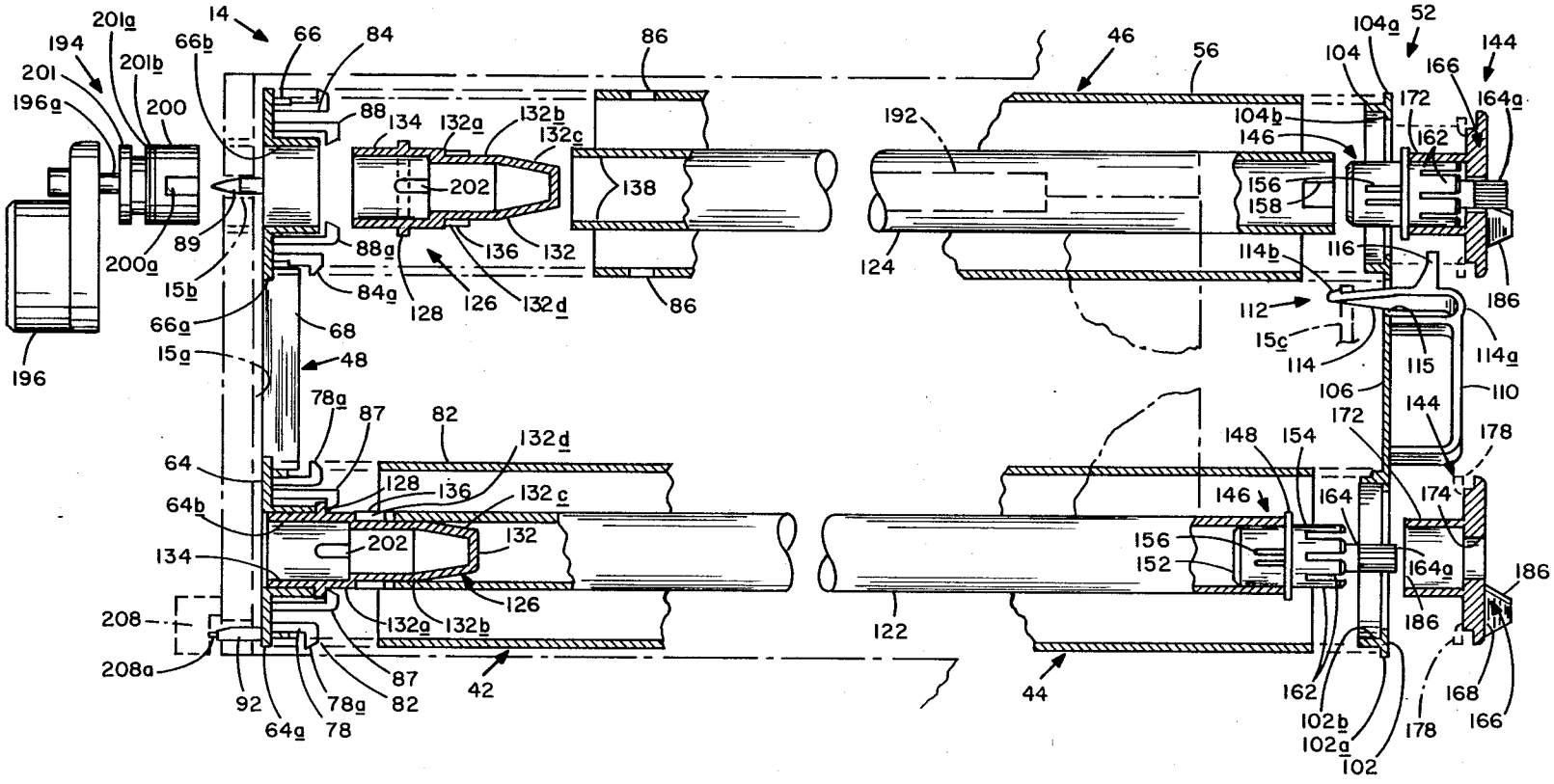
FIG. 3 is an exploded view in section on a still larger scale taken along line 3—3 of FIG. 2.

For purposes of this description, we will describe the invention cartridge in the context of a rotary drum-type thermal printer. It should be understood, however, that the principles of the invention may be applied to a cartridge or cassette to house, handle and feed the print ribbons used in other types of printers.

Referring first to FIG. 1 of the drawings, color printing apparatus includes a print head 10 which is positioned opposite a rotary drum 12. Located also opposite drum 12 adjacent to the head 10 is a print ribbon cartridge shown generally at 14 made in accordance with our invention. Cartridge 14 is located properly relative to the print head 10 and drum 12 by placing it in a fitted receptacle or pocket 15*a* of the printing apparatus frame or base 15. Cartridge 14 includes a print or thermal transfer ribbon 14*a* that extends into the gap between head 10 and the surface of drum 12. The length of ribbon 14*a* is composed of a repeating set of different color bands C, M and Y (FIG. 4) and a planar stretch of ribbon 14*a* opposite head 10 is exposed by the cartridge 14 to both the print head 10 and the drum surface.

Supported on the drum 12 is a recording medium such as a sheet of paper S shown in dot-dash lines in FIG. 1 whose leading edge is secured to the drum 12 by a clip 16 incorporated into the drum 12. During operation of the printing apparatus, the head 10 is moved between a "print" position in which the head 10 presses ribbon 14*a* and sheet S against the drum 12 and a "feed" position in which the head 10 is retracted from the drum 12 so that the ribbon 14*a* and drum 12 can be moved relative to the head 10. Typically, the printing apparatus is designed to print on a standard size sheet S, e.g. $8\frac{1}{2}\times 11$ inches. Therefore, the head 10 and drum 12 are at least $8\frac{1}{2}$ inches long and the drum 12 has a circumference in excess of $11\frac{1}{2}$ inches. The ribbon 14*a* is slightly less than $8\frac{1}{2}$ inches wide and its length may be as long as 3300 inches or even longer. This specific ribbon length accomodates 100 sets of three color bands Y, M, C, each such band being 11 inches long.

The printing apparatus includes a paper sheet feed path in the form of a guide 22 for guiding a paper sheet S shown in solid lines in FIG. 1 from a sheet feeder (not shown) in the direction of arrow 24 such that its leading edge is directed into clip 16 when the drum 12 is stopped by its drive means (not shown) at its so-called "release position" and the clip 16 is open as shown in solid lines in FIG. 1. The apparatus also has a paper discharge path in the form of a second guide 26 positioned with one end adjacent clip 16, when the drum 12 is oriented as in FIG. 1, to receive the paper sheet S as it is ejected from clip 16 in the direction of arrow 28. The sheet feeder, the clip 16, head 10 and the means for operating them in synchronism with the rotation of drum 12 are not parts of the present invention. Therefore, they will not be described in detail here. For fuller descriptions of those elements of the printing apparatus, see copending application Ser. No. 765,079, of even date herewith, entitled THERMAL PRINTER, now U.S. Pat. No. 4,594,597 issued June 10, 1986 to Dean-Yuan Liu et al, which application is owned by the assignee of the present application. It is enough to say here that drum 12 is rotatable in both directions by the drive means. Clockwise rotation as indicated by the arrow 32 in FIG. 1 shall be referred to as the "printing direction" and counterclockwise rotation as shown by the dot-dash arrow 34 shall be referred to as the "release direction". When rotating the drum 12 in the printing direction of the arrow 32, the drive means of the apparatus is also arranged to stop the drum 12 in a "top-of-sheet" position in which the closed clip 16 is located adjacent to the print head 10 as indicated by the dot-dash lines in FIG. 1 so that the print head 10 is positioned to print the first line on the paper sheet S.

In describing the general operation of the apparatus, we will assume that drum 12 is stopped at its release position and clip 16 is open as shown in solid lines in FIG. 1. With the clip 16 in that position, a paper sheet S can be fed along guide 22 in the direction of arrow 24 so that its leading edge is received in the gap 38 present between the clip 16 and the drum surface. As soon as that occurs, clip 16 is closed thereby clamping that edge to the drum 12 and drum 12 is rotated in the printing direction indicated by arrow 32 to its top-of-sheet position so that sheet S becomes wrapped around the drum 12 as indicated by the dot-dash lines in FIG. 1. The circumference of drum 12 is related to the length of sheet S and the placement of guide 26 such that, when the drum 12 is in its top-of-sheet position, the trailing edge margin S′ of sheet S rests on the paper guide 26 as shown in FIG. 1.

The printing apparatus now commences the first printing sequence. First, the printer controller (not shown) moves the print head 10 to its print position so that it presses print ribbon 14*a* and the sheet S against the surface of drum 12. Immediately thereafter, the wires (not shown) of print head 10 are energized selectively and the drum 12 is stepped around following the above-described print-and-feed sequence until all of the line positions on sheet S are printed with first color dots. During this time, the ribbon 14*a* in cartridge 14 is advanced so that the first color band Y in the first set of bands Y, M, C on the ribbon 14*a* is moved past the head 10. Then head 10 is moved to its retracted feed position while drum 12 continues rotating in the printing direction indicated by arrow 32 to its top-of-sheet position. At the same time, ribbon cartridge 14 is driven to advance the print ribbon 14*a* therein to bring the beginning of the second color band M opposite the print head wires. Then head 10 is returned to its print position to commence printing the second color on sheet S, with the print ribbon 14*a* being advanced to move the second color band M of the first set past the head 10. This process is repeated until the sheet S has been printed with all of the colors present in the repeating set of bands Y, M, C on the print ribbon 14*a*.

Upon completion of printing, drum 12 is rotated once again to its top-of-sheet position placing the tail end S′ of the sheet S on guide 26 as shown in dotted lines in FIG. 1. Drum 12 is now rotated in its release direction shown by arrow 34 in FIG. 1, causing the sheet S wrapped around the drum 12 to be pushed outward along the paper guide 26 in the direction of arrow 28. When the drum 12 reaches its release position shown in FIG. 1, clip 16 is opened as shown, thereby releasing the leading edge of the sheet S so that the sheet S is ejected along guide 26 to the exit end of the printing apparatus.

Turning now to FIGS. 2 and 3 of the drawings, cartridge 14 comprises a casing or housing 42 composed of four molded plastic sections to be described presently which interfit to form a protective enclosure and a guide path for the print ribbon 14*a*. More particularly, casing 42 includes a feed tube section 44, a take-up tube section 46 and a pair of left and right end sections 48 and 52 respectively. Feed tube section 44 is essentially an open ended tube having a lengthwise rectangular slot 54 which must be long enough to accommodate ribbon 14*a*. Thus, the illustrated cartridge 14 has a slot 54 which is at least $8\frac{1}{2}$ inches long. Casing section 46 includes a tubular portion 56 which is open at both ends and has a ribbon-receiving slot 58 which is more or less the same size as slot 54. Section 46 also includes a blade portion 62 integral with tube portion 56. As the cartridge 14 is oriented in FIG. 2, portion 62 projects out laterally from tube portion 56 at the lower edge of slot 58. The blade portion 62 extends the entire length of section 46 and its outer edge margin is beveled and notched to form a sharp-edged turnbar 62*a* for turning the print ribbon 14*a* in its path of travel from slot 54 to slot 58. The turnbar 62*a* is slightly longer than the width of the ribbon 14*a* and prevents the advancing ribbon 14*a* from wandering laterally.

The two casing sections 44 and 46 are held in spaced-parallel relation with the turnbar 62*a* positioned between their slots 54 and 58 by the casing end sections 48 and 52. Section 48 is composed of a pair of similar annular bushings 64 and 66 which plug into the adjacent open ends of the feed tube section 44 and the tubular portion 56 of the take-up tube section 46. When that end section 48 is in place, the bushing flanges 64*a* and 66*a* are more or less flush with the outside walls of sections 44 and 46. As best seen in FIG. 2, section 48 also includes a strap 68 whose lower end, along with a reinforcing web 69, is an integral extension of bushing flange 64*a* and whose upper end is connected to bushing flange 66*a* by way of an integral web 72. Strap 68 lies in a plane that is more or less perpendicular to the nominal plane of section 48 and its upper end has a notch 68*a* to provide clearance for the adjacent end of turnbar 62*a*.

To help establish the proper relative positions of casing sections 44, 46 and 48, one or more small tabs 74 project from the ends of sections 44 and 46, including the latter's blade portion 62, into registering slots 76 present in end section 48 seen in FIG. 2. Section 48 is secured to sections 44 and 46 by a circular array of clips 78 formed integrally with bushing 64. These clips 78 extend into the end of section 44 and have noses or barbs 78*a* which snap into small slots 82 formed in the wall of section 44. Similar clips 84 extend from bushing 66 into tube portion 56 with the barbs 84*a* at the ends of those clips 84 engaging in appropriately placed slots 86 present in the wall of portion 56.

A second circular array of integral clips 87 project from bushing 64 parallel to clips 78 and a similar array of clips 88 project from bushing 66 parallel to clips 84. The clips 87, 88 in these arrays have barbed ends 87*a* and 88*a* respectively which overhang their respective bushing passages 64*b* and 66*b* respectively. The purpose of these clips 87 and 88 will be described later.

Referring to FIGS. 1 and 3, a pair of locating pins 89 project straight out from casing end section 48 at diametrically opposite locations adjacent its bushing 66. When the cartridge 14 is loaded into its receptacle 15*a*, these pins 89 project into holes 15*b* in the end wall of the receptacle 15*a* to fix the position of the cartridge 14. Also, a small finger or post 92 whose function will be described later extends out in the same direction from section 48 at a location adjacent its bushing 64.

Referring now to FIGS. 2 and 3, the casing section 52 that connects the opposite ends of sections 44 and 46 comprises a pair of similar annular bushings 102 and 104 having peripheral flanges 102*a* and 104*a* and central passages 102*b* and 104*b* respectively. The bushings 102 and 104 are arranged to plug into the adjacent open ends of section 44 and tubular portion 56 of section 46 respectively. The bushings 102 and 104 are joined by an integral planar web portion 106 which bridges the adjacent end of blade portion 62. Small tabs 108 project from the adjacent end of blade portion 62 into registering slots 109 in end portion 106 as best seen in FIG. 2. Section 52 is permanently secured to sections 44 and 46 by applying an appropriate cement or bonding agent (not shown) to section 52 at the location of holes 109 and around the bushings 102 and 104. If desired, a similar cement may be applied to the appropriate surfaces of the opposite casing end section 48 in order to permanently bond that section to sections 44 and 46.

The casing end section 52 also is formed with an integral handle 110 to facilitate loading cartridge 14 into and withdrawing it from its receptacle 15*a* in the apparatus frame 15. The handle 110 is essentially a generally rectangular loop or strap whose opposite ends connect to the end section web portion 106 at spaced-apart locations thereon between bushings 102 and 104. Also formed as an integral part of the handle 110 is a latch 112 for releasably locking cartridge 14 in its receptacle 15*a*. The latch 112 is basically a resilient clip member 114 which branches at 114*a* from one end of handle 110, curves and extends through a clearance hole 115 provided in the web portion 106. The clip member 114 is terminated by a barb 114*b* spaced a short distance from the opposite face of web portion 106. A tab 116 extends laterally from the clip member 114 at a location thereon between its connection at 114*a* and web portion 106. When tab 116 is depressed, the clip member 114 resiliently flexes at its bridging connection 114*a* to handle 110 causing the barb 114*b* of the clip member 114 to swing away from tubular portion 56 of the casing section 46. When cartridge 14 is properly seated in its frame receptacle 15*a*, the barb 114*b* of the clip member 114 engages behind a fram edge 15*c* as shown in FIG. 3 so that the cartridge 14 stays in its proper position despite the normal movements and vibrations of the apparatus while printing. The cartridge 14 can be removed from the apparatus simply by disengaging the clip member 114 from frame edge 15*c* by depressing tab 116 while pulling on the cartridge handle 110.

Referring now to FIG. 3 of the drawings, cartridge 14 also includes a pair of tubular open-ended ribbon spools or cores 122 and 124 positioned inside casing section 44 and the tubular portion 56 of casing section 46 respectively. The ends of those cores 122 and 124 adjacent to the casing end section 48 are rotatively mounted to that section's bushings 64 and 66 by a pair of identical generally cylindrical plug members 126. Each plug member 126 is formed with a circumferential flange 128 which divides the member 126 lengthwise into inner and outer segments 132 and 134. Segment 132 is relatively long with a generally cylindrical portion 132*a* adjacent flange 128, an intermediate slightly smaller diameter portion 132*b* and a tapered or frustoconical portion 132*c*. Plug member 126 is dimensioned to fit somewhat snugly into the end of the associated ribbon core 122 or 124 so that the tube end seats on the shoulder 132*d* present between the plug segment portions 132*a* and 132*b* as shown in the lower half of FIG. 3. A pair of lengthwise tapered splines or keys 136 are formed at diametrically opposite locations on plug segment portion 132*b*. These are slidably received in diametrically opposite slots 138 in the adjacent end wall of the associated ribbon core 122 or 124 so that, when the plug member 126 is plugged into the end of the core 122 or 124 as shown in the lower half of FIG. 3, the two are rotatively locked together.

The plug member segment 134 on the opposite side of flange 128 is generally cylindrical with open ends and dimensioned to fit rotatively in the central passage 64*b* or 66*b* of the associated bushing 64 or 66. The plug member segment 134 is rotatively locked to the associated bushing 64 or 66 by the above-mentioned clips 87 or 88 projecting from that bushing 64 or 66. As the plug member 126 is slid into the bushing passage 64*b* or 66*b*, its flange 128 deflects those clips 87 or 88 radially outward until the flange 128 seats on the circular edge of the bushing passage 64*b* whereupon the clip barbs 87*a* or 88*a* engage over the flange 128 as shown in the lower half of FIG. 3. Thus, by means of these plug members 126, the ribbon core 122 is rotatively coupled to bushing 64 and core 124 is similarly coupled to bushing 66. It will be appreciated from the foregoing that, even if the casing end sections 48 and 52 are permanently bonded to the opposite ends of sections 44 and 46, the plug members 126 can still be installed or assembled into the casing sections 44 and 46 simply by fitting them into the ends of their respective ribbon cores 122 and 124 and sliding the plug members 126 and cores 122 and 124 into the casing sections 44 and 46 through the bushing passages 102*b* and 104*b* in casing end section 52 until the plug members 126 are coupled to section 48 as described above.

The opposite ends of the ribbon cores 122 and 124 proximal to casing end section 52 are rotatively supported within the casing 42 by a pair of identical removable end cap assemblies shown generally at 144 which are releasably secured in the bushing openings 102*b* and 104*b* respectively of section 52. Each cap assembly 144 comprises a generally cylindrical plug-like friction member 146 which is divided lengthwise by a circumferential flange 148 into inner and outer segments 152 and 154. Segment 152 is generally cylindrical and is arranged to plug tightly into the adjacent end of the associated ribbon core 122 or 124. A lengthwise key or spline 156 extends along one side of segment 152 which engages in a notch 158 present in the end wall of the ribbon core 122 or 124 to rotatively couple the friction member 146 to the core 122 or 124. The other drag member segment 154 is also more or less cylindrical. However, it is slotted lengthwise to form a circular array of resilient fingers 162. In addition, a relatively long cylindrical post 164 extends axially from member segment 154 beyond the ends of fingers 162 and the free end 164*a* of that post 164 is knurled so that it can function as a stem for manually turning the friction member 146 and the ribbon core 122 or 124 coupled thereto. The friction member segment 154 of member 146 is rotatively connected to a cap 166 which constitutes the remaining component of the cap assembly 144. Cap 166 is composed of a flanged disk portion 168 whose flange diameter is slightly larger than the diameters of the openings 102*b* and 104*b* in the casing end section 52. Projecting endwise from the inner face of disk portion 168 is a tubular portion 172 which is dimensioned to engage snugly around the friction member segment 154. A central opening 174 is provided in disk portion 168 to provide clearance for post 164. Thus, when the friction member 146 is positioned in its cap 166 with its flange 148 seated on the end of the cap tube portion 172 as shown in the upper half of FIG. 3, the friction member 146 can be rotated relative to the cap 166, say, by turning the stem 164*a* projecting from the cap 166. However, the engagements of the friction member's resilient fingers 162 against the wall of tube portion 172 provide a certain amount of resistance to such rotation.

Each cap 166 has a pair of tabs 178 which extend out diametrically from the edge of its disk portion 168. These tabs 178 are arranged to key into diametrically placed notches 182 at the edge of the bushing passage 102*b* or 104*b* which that cap 166 is intended to close. When the cap assembly 144 and the core 122 or 124 coupled to it are oriented as shown in the lower half of FIG. 2, the locking tabs 178 are aligned with notches 182 so that the core 122 or 124 and cap assembly 144 can be slid into the casing 42 until the disk portion 168 of that assembly 144 seats in and closes the bushing passage 102*b* or 104*b*. If the assembly 144 is then rotated clockwise to the position shown in the upper half of FIG. 2 using the ears 186 projecting from the outer face of the disk portion 168, the tabs 178 will engage under the flanged outer edge of the bushing passage 102*b* or 104*b* thereby locking the cap assembly 144 to the casing 42. Preferably, a pair of ramps 188 are formed on the inside surface of the casing end section 52 adjacent to notches 182 as shown in the lower half of FIG. 2 so that, when the cap assembly 144 is seated and rotated in the locking direction just described, the ramps 188 will wedge tabs 178 inward until they reach stops 188*a* present at the inner ends of the ramps 188, thereby drawing the cap assembly 144 tightly against the end of the cartridge casing 42. If desired, a knob may be frictionally engaged over each stem 164*a* to make it easier to turn the stem 164*a* and to hold the friction member segment 154 and its cap 166 together as an assembled unit. One such knob, indicated in dot-dash lines at 190, is affixed to the upper stem 164*a* in FIG. 2.

In order to load cartridge 14 with a fresh print ribbon 14*a*, each cap assembly 144 is released from the casing 42 by rotating its cap 166 in the unlocking, i.e. counterclockwise, direction. When the cap assembly 144 is retracted from the end of the casing 42 as shown in the lower half of FIG. 2, the ribbon core 122 or 124 coupled to it will be retracted also because the core 122 or 124 fits more tightly to the cap assembly 144 than to the plug member 126 at the opposite end of the casing 42. The empty core 122 or 124 can then be separated from the cap assembly 144 and replaced by a similar core or spool 122 or 124 having a length of print ribbon 14*a* wrapped about the core 122 or 124. This spooled ribbon 14*a* would normally be provided in a sealed package with a strip of adhesive tape 192 (FIG. 3) securing the outer leading edge of the ribbon 14*a*. Then the new ribbon 14*a* and cover assembly 144 are inserted into the cartridge casing section 44 and locked in place as described above and an empty core 122 is similarly positioned in the tubular portion 56 of the take-up section 46. Next, the user draws the leading end of the ribbon 14*a* with the adhesive strip 192 still attached out through the casing section slot 54. That slot 54 is made large enough so that the user can insert his fingers into section 44 to grasp the ribbon 14*a*. The ribbon 14*a* is draped over the turnbar 62*a* and threaded in through the other large casing slot 58 and attached to the empty core 124 present in the casing section 46 using the adhesive strip as shown at 192 in FIG. 3. Then, by turning the stems 164*a* at the end of casing 42, the leading end of the ribbon 14*a* can be wrapped to some extent around core 124 and the ribbon 14*a* made taut.

As best seen in FIG. 2, section 44 and portion 56 of cartridge 14 are juxtaposed so that their longitudinal axes are parallel and define a first plane. The turnbar 62*a* is spaced from that plane and its edge together with the proximal edge of slot 54 defines a second plane which intercepts the first plane making an acute angle therewith. Consequently, a large unobstructed stretch of ribbon 14*a* is present between the slot 54 and turnbar 62*a* which is accessible from behind to a long print head 10 positioned between casing section 44 and portion 56 of section 46.

When loading fresh ribbon 14*a* into the cartridge casing 42 thusly, the ribbon 14*a* should be fed from and taken up on the sides of the cores 122 and 124 facing the sides of the casing 42 as shown in FIG. 2 so that a segment of the ribbon 14*a* is stretched properly between the inner edge of slot 58 and the edge of turnbar 62*a*. The proper orientation of each ribbon core 122 and 124 is assured because only the core end containing the two slots 138 will engage properly on each plug member 126 projecting from the casing end section 48.

Referring now to FIG. 3, the ribbon 14*a* is advanced from core 122 in casing section 44 to core 124 in casing section 46 by a motor drive assembly shown generally at 194. Assembly 194 includes a small electric gear motor 196 which is mounted to the printing apparatus frame 15 at the inner end of the cartridge receptacle 15*a* adjacent the locating holes 15*b*. The gear motor 196 has an armature 196*a* which is rotatively coupled to a drive member 200 by way of a simple, low cost mechanical slip clutch 201 which includes a spring-loaded plate 201*a* and a clutch pad 201*b*. The diameter of the driver member 200 is such that, when the cartridge 14 is seated in its receptacle 15*a*, the driver member 200 can be slidably received in the segment 134 of the plug member 126 coupled to the bushing 66 of cartridge end section 48. A pair of lengthwise slots 200*a* are formed at diametrically opposite locations on the driver member 200. These slots 200*a* are arranged to receive diametrically opposite lengthwise splines or keys 202 projecting from the inner surface of plug member 126 as shown in FIG. 3, so as to rotatively couple the driver member 200 to the plug member 126 as well as to the ribbon core 124 attached thereto. When motor 196 is energized, the core 124 is rotated to wind the ribbon 14*a* onto that core 124, thereby advancing the print ribbon 14*a* over the turnbar 62*a* in the direction indicated by the arrow 206 in FIG. 2.

The slip clutch 201 is an important feature of the invention. It permits the use of a single gear motor 196 in place of an expensive servo motor (not shown) and its ancillary control circuitry (not shown) as the means for advancing ribbon 14*a* even though the ribbon 14*a* moves at different speeds during the operation of the printer. More particularly, it is desirable to advance the ribbon 14*a* rapidly when positioning the ribbon 14*a* prior to printing each different color. During printing, on the other hand, when the ribbon 14*a* is being advanced line by line, the ribbon movement is much slower. In addition, assuming the ribbon take-up core 124 is rotated at constant speed, the surface speed of the ribbon 14*a* at the print station will vary directly with the radius of the ribbon roll or core 124. With clutch 201, motor 196 can be run at a selected constant speed that will position the ribbon 14*a* promptly prior to printing even when core 122 is almost empty of ribbon 14*a*. As described previously, the print head 10 is in its retracted position during this time so that the ribbon 14*a* is free to move rapidly. Then, during printing, when the head 10 is in its print position and the ribbon 14*a* is retarded by its engagement with the head 10, the clutch 201 will slip, permitting the motor armature 196*a* to overrun the driver member 200 whenever the torque exerted on the driver member 200 becomes excessive due to such retardation or to ribbon 14*a* buildup on core 124. Consequently, the motor 196 is never overloaded due to the different ribbon speeds or even if the ribbon 14*a* is stopped because of a jam.

In order to assure that the cartridge 14 is properly seated in receptacle 15*a* before motor 196 is energized to advance the ribbon 14*a*, a microswitch 208 is mounted on the end wall of receptacle 15*a* with its actuator 208*a* located directly opposite the finger 92 described above that projects from the end of the loaded cartridge 14. The closing of that switch 208 provides an indication to the apparatus controller (not shown) that the cartridge 14 is seated properly and is ready to commence printing.

After the ribbon 14*a* has been used up during successive printing operations by the printing apparatus so that its entire length is coiled up on core 124 in casing section 46, the cartridge 14 is removed from its receptacle in the printer by depressing the latch tab 116 and pulling on the cartridge handle 110. Then the cap assemblies 144 at the end of the casing 42 are unlocked and withdrawn, along with the cores 122 and 124, from the casing 42. The used ribbon 14*a* is discarded, saving the core 124 if desired. Then the now empty core 122 in the casing section 44 can be repositioned in section 46 to serve as the take-up core 124 for a new spooled ribbon 14*a* inserted into section 44 as described above. Thus, all of the components of cartridge assembly 14 except the print ribbon 14*a* are reusable so that the cost of the cartridge 14 can be amortized over a long period of time. Finally, the cartridge 14 is returned to and locked in its receptacle 15*a* using the convenient handle 110 and latch 112 provided on the cartridge 14.

As mentioned above, the cartridge 14 normally contains a print ribbon 14*a* for color printing composed of repeating sets of color bands or fields having the colors yellow (Y), magenta (M) and cyan (C), as shown in FIG. 4. A typical ribbon 14*a* may have one hundred or more repeats of the three color set YMC. To mark the beginning of each color band, the band is preceded with a black index stripe or marking 212 as shown in FIG. 4. The stripe 212*a* preceding each color set, i.e. ahead of each yellow band, is made longer than the stripe 212 to define the beginning of each set. A pair of detectors 214 and 214*a* are mounted on the apparatus frame 15 so that, when the cartridge 14 is seated in that receptacle 15*a*, the detectors 214 and 214*a* are located opposite the exposed segment of ribbon 14*a* at the print station as shown in FIGS. 1 and 2 in position to detect the stripes 212 and 212*a* respectively. The detector 214*a* provides an indication to the apparatus controller that the ribbon 14*a* is positioned at the beginning of a three-color set and is thus ready to commence printing on a sheet S. The detection by detector 214 of a stripe 212 or 212*a* indicates to the controller that the ribbon 14*a* is positioned to print each successive color within a color set. Thus, the stripes 212 and 212*a* provide initialization information at the beginning of a printing cycle as well as ribbon position information with respect to each of the color bands Y, M, C on the ribbon 14*a* within a given cycle while printing the different colors on sheet S.

The detectors 214 and 214*a* can even be arranged to identify the particular color band Y, M or C present or moving into the print station of the apparatus. The controller can then position the ribbon 14*a* selectively so that, as each color band is required, it is moved into the print station.

It will be seen from the foregoing, then, that the cartridge 14 greatly facilitates the handling of print ribbons 14*a* and especially the large thermal transfer ribbons 14*a* customarily used in thermal printers. The cartridge 14 is very user friendly in that it can be inserted into and removed from its receptacle 15*a* in the printing apparatus quite easily using the handle 110 and integral latch 112. During the operation of the printing apparatus, the ribbon 14*a* in the cartridge 14 is properly positioned prior to printing each different color on sheet S as well as during printing by a simple inexpensive gear motor assembly 194 instead of by a servo drive as is commonly done in conventional printers of this type, with the proper position of the ribbon 14*a* being assured by the detection of the position stripes 212 and 212*a* present on the ribbon 14*a*. When the ribbon 14*a* is used up, the user can remove the cartridge 14 from the printing apparatus and replace the ribbon 14*a* with a fresh one so that the same cartridge 14 can be used again and again. The construction of the cartridge 14 described above enables the user to remove the ribbon cores 122 and 124 from the cartridge casing 42, insert a fresh ribbon 14*a* into the casing 42 and reuse the empty core 124 as the take-up core 124 for the new ribbon 14*a* with minimum effort. Therefore, the present cartridge 14 should find wide application, particularly in thermal printers of the type requiring unusually large print ribbons 14*a* to print in color on successive sheets S of paper.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A print ribbon cartridge for slidable positioning endwise in a cartridge receptacle at the printing station of a printer, said cartridge comprising A. a first casing section, said first section including
  (1) a tube having a first longitudinal axis and two ends, at least one of which is axially open, and
  (2) means defining a first slot in said tube which is parallel to said first axis;

B. a second casing section including
  (1) a tubular portion having a second longitudinal axis and two ends, at least one of which is axially open, and
  (2) means defining a second slot in said tubular portion which is parallel to said second axis;

C. first and second connecting means for connecting together said one and the other ends of said tube and tubular portion respectively so that
  (1) said first and second axes are parallel to one another and define a first plane, and
  (2) said one end of said tube and tubular portion are positioned adjacent to one another at one end of the cartridge;

D. a ribbon turnbar
  (1) integral to and projecting from said tubular portion,
  (2) extending between corresponding outer edges of said first and second connecting means along a line spaced from said first plane so that, together with said second slot, said turnbar defines a second plane at the outermost extent of said cartridge which makes an acute angle with said first plane;

E. corresponding first support means secured to said first connecting means for rotatively supporting ribbon cores in said tube and tubular portion respectively;

F. corresponding second support means secured to said second connecting means for rotatively supporting ribbon cores in said tube and tubular portion respectively; and G. means for rotating one of said support means.

2. The cartridge defined in claim 1 wherein

A. said first connecting means and said first support means constitute a first integral unit; and B. said second connecting means and said second support means constitute a second integral unit.

3. The cartridge defined in claim 2 wherein said second connecting means comprise a flat strap lying in said second plane.

4. The cartridge defined in claim 3 wherein said first connecting means comprise a web A. extending between said second corresponding support means; and B. which lies in a third plane that is perpendicular to said first and second planes.

5. The cartridge defined in claim 1 wherein said rotating means comprise an external stem connected to one of said first and second support means.

6. The cartridge defined in claim 1 wherein said rotating means comprise A. motive means having rotary output means; and B. means for rotatively locking said output means to one of said second support means.

7. The cartridge defined in claim 6 wherein

A. said motive means include an electric gear drive; and

B. said output means include
  (1) a rotary drive member; and
  (2) clutch means coupled between said gear drive and said driver member.

8. The cartridge defined in claim 6 and further including latch means integral to said first connecting means for latching said cartridge in said receptacle.

9. The cartridge defined in claim 8 and further including means defining a cartridge handle integral to said latch means.

10. The cartridge defined in claim 1 and further including handle and latch means integral to said first connecting means for holding and latching said cartridge in said receptacle.

11. The cartridge defined in claim 1 and further including first and second ribbon cores releasably supported by said corresponding first and second support means in said tube and tubular portion respectively.

12. The cartridge defined in claim 11 and further including a print ribbon wound on said cores and having a stretch extending out of said slots and over said turnbar.

13. The cartridge defined in claim 12 wherein the length of said ribbon is composed of a repeating set of different-color bands.

14. The cartridge defined in claim 13 and further including first detectable indicia on said ribbon indicating the beginning of each color band.

15. The cartridge defined in claim 14 and further including second detectable indicia on said ribbon indicating the beginning of each color set.

16. The cartridge defined in claim 1 wherein said corresponding second support means each comprise A. means defining a passage at said opposite end of said tube or tubular portion;

B. a rotary plug member, said plug member having (1) a first end rotatively received in said passage, and (2) a second end interfittable with a ribbon core to rotatively lock said plug to the core.

17. The cartridge defined in claim 16 and further including means for axially locking said rotary plug member first end in said passage.

18. The cartridge defined in claim 1 wherein at least one of said corresponding first support means comprise A. means defining a passage at said one end of one of said tube and tubular portion;

B. a removable cap assembly, said cap assembly including (1) a closure member for closing said passage;

(2) a friction member, said friction member having a first end interfittable with a ribbon core to rotatively lock said friction member to the core, and (3) coacting means on said friction member second end and said closure member which interfit to rotatively couple the friction member to the closure member with a degree of resistance to such rotation.

19. The cartridge defined in claim 18 and further including

A. means defining an axial hole through said closure member;

B. a post extending axially from said friction member through said hole, the free end of which constitutes a stem on the outside of said one cartridge end for turning said friction member and any ribbon core interfitted therewith.

20. The cartridge defined in claim 19 and further including means for releasably locking said closure member to said friction member second end.

21. The cartridge defined in claim 18 wherein

A. said closure member includes a tubular section whose axis corresponds to the axis of one of said tube and portion;

B. a segment of said friction member including its second end is slitted lengthwise to form a circular array of resilient fingers which are frictionally engaged to said closure member tubular section.

22. A print ribbon cartridge for slidable positioning endwise in a cartridge receptacle at the printing station of a printer, said cartridge comprising A. a first casing section, said first section including (1) a first open-ended tube having a first longitudinal axis, and (2) means defining a first slot in said first tube which is parallel to said first axis;

B. a second casing section including (1) a second open-ended tube having a second longitudinal axis, and (2) means defining a second slot in said second tube which is parallel to said second axis;

C. first and second connecting means for connecting together the first and second ends of said tubes respectively so that said first and second axes are parallel to one another and define a first plane;

D. corresponding first support means at the first ends of said tubes for rotatively supporting ribbon cores in said tubes;

F. a ribbon turnbar extending between said first and second connecting means parallel to said axes and along a line spaced from said first plane so that said turnbar and one of said slots define a second plane which makes an acute angle with said first plane;

G. motive means including (1) an electric gear drive, (2) a rotary driver member, and (3) slip clutch means coupled between said gear drive and said driver member; and H. means for rotatively coupling said driver member to said second support means; and I. handle means on said first connecting means to facilitate endwise loading of said cartridge into said receptacle with simultaneous engagement of said driver member with said second support means.

23. The cartridge defined in claim 22 and further including latch means integral to said first connecting means for latching said cartridge in said receptacle.

24. The cartridge defined in claim 23 wherein said cartridge handle is integral to said latch means.

25. The cartridge defined in claim 22 and further including first and second ribbon cores supported by said corresponding first and second support means in said tubes.

* * * * *